US010559438B2

(12) United States Patent
Moonamkandy et al.

(10) Patent No.: US 10,559,438 B2
(45) Date of Patent: Feb. 11, 2020

(54) TOGGLE SWITCH ACTUATING MECHANISM

(71) Applicant: Honeywell International Inc., Morris Plains, NJ (US)

(72) Inventors: Shakil Moonamkandy, Bangalore (IN); Phaneendra Govindasetty Tirumani, Bangalore (IN); Niranjan Manjunath, Bangalore (IN); Michael Jay Skarlupka, Freeport, IL (US)

(73) Assignee: Honeywell International Inc., Morris Plains, NJ (US)

( * ) Notice: Subject to any disclaimer, the term of this patent is extended or adjusted under 35 U.S.C. 154(b) by 111 days.

(21) Appl. No.: 15/653,033

(22) Filed: Jul. 18, 2017

(65) Prior Publication Data

US 2018/0025866 A1 Jan. 25, 2018

(30) Foreign Application Priority Data

Jul. 22, 2016 (IN) ..... 201611025195

(51) Int. Cl.

| | |
|---|---|
| ***H01H 23/14*** | (2006.01) |
| ***H01H 21/22*** | (2006.01) |
| ***H01H 23/16*** | (2006.01) |
| ***H01H 21/04*** | (2006.01) |
| ***H01H 21/36*** | (2006.01) |

(52) U.S. Cl.

CPC ..... *H01H 21/22* (2013.01); *H01H 21/04* (2013.01); *H01H 21/36* (2013.01); *H01H 23/146* (2013.01); *H01H 23/164* (2013.01); *H01H 23/168* (2013.01); *H01H 2235/01* (2013.01)

(58) Field of Classification Search

CPC .. H01H 21/22; H01H 2021/225; H01H 21/42; H01H 23/168; H01H 23/20; H01H 23/205; H01H 23/24; H01H 23/146; H01H 23/164

See application file for complete search history.

(56) References Cited

U.S. PATENT DOCUMENTS

| | | | | |
|---|---|---|---|---|
| 2,835,754 A | | 5/1958 | Lewis | |
| 3,715,534 A | | 2/1973 | Piber | |
| 4,215,257 A | * | 7/1980 | Repplinger ..... | H01H 3/20 200/322 |
| 4,272,662 A | | 6/1981 | Simpson | |
| 6,943,310 B2 | * | 9/2005 | Eisenhower ..... | H01H 1/58 200/302.3 |

* cited by examiner

*Primary Examiner* — Felix O Figueroa
(74) *Attorney, Agent, or Firm* — Craige Thompson; Thompson Patent Law

(57) ABSTRACT

A toggle switch comprises a housing, a plurality of switches disposed within the housing, an actuating lever coupled to a pivot pin, and an actuator assembly coupled to the actuating lever. The actuating lever extends into the housing. The actuator assembly comprises an actuation pin coupled to the actuating lever, and a spring disposed about the actuating lever. The actuation pin is configured to actuate one or more of the plurality of switches, and the spring is configured to bias a cam follower into engagement with a cam profile on a bracket and bias the actuating lever into an actuation position.

17 Claims, 4 Drawing Sheets

TOGGLE SWITCH ACTUATING MECHANISM

CROSS-REFERENCE TO RELATED APPLICATIONS

This application claims priority to India Patent Application Serial No. 201611025195 (entitled TOGGLE SWITCH ACTUATING MECHANISM, filed Jul. 22, 2016 with the Government of India Patent Office), which is incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A toggle switch is a switch in which a projecting lever can be manipulated to open or to close an electric circuit. Toggle switches of various types have been utilized to control power in domestic, commercial, and industrial applications for operating various electrical devices and equipment.

SUMMARY

In an embodiment, a toggle switch comprises a housing, a plurality of switches disposed within the housing, an actuating lever coupled to a pivot pin, and an actuator assembly coupled to the actuating lever. The actuating lever extends into the housing. The actuator assembly comprises an actuation pin coupled to the actuating lever, and a spring disposed about the actuating lever. The actuation pin is configured to actuate one or more of the plurality of switches, and the spring is configured to bias a cam follower into engagement with a cam profile on a bracket and bias the actuating lever into an actuation position.

In an embodiment, a method of operating a toggle switch comprises providing an actuation force to an actuating lever while the actuating lever is in a first actuation position, moving a cam follower along a cam profile from the first actuation position to a peak in the cam profile in response to the actuation force, compressing a spring disposed about the actuating lever in response to the moving, de-actuating a first switch in response to the moving, actuating the cam follower along the cam profile from the peak to a second actuation position based, at least in part, on a bias force provided by the compressed spring, and actuating a second switch in response to actuating the cam follower to the second actuation position.

In an embodiment, a toggle switch comprises a housing, a plurality of switches disposed within the housing, an actuating lever configured to rotate about a pivot point, and an actuator assembly coupled to the actuating lever. The actuating lever extends into the housing. The actuator assembly comprises an actuation pin coupled to the actuating lever, and a spring configured to bias a cam follower into engagement with a cam profile and bias the actuating lever into an actuation position. The actuation pin is configured to actuate one or more of the plurality of switches, and the pin is coupled to the actuating lever.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
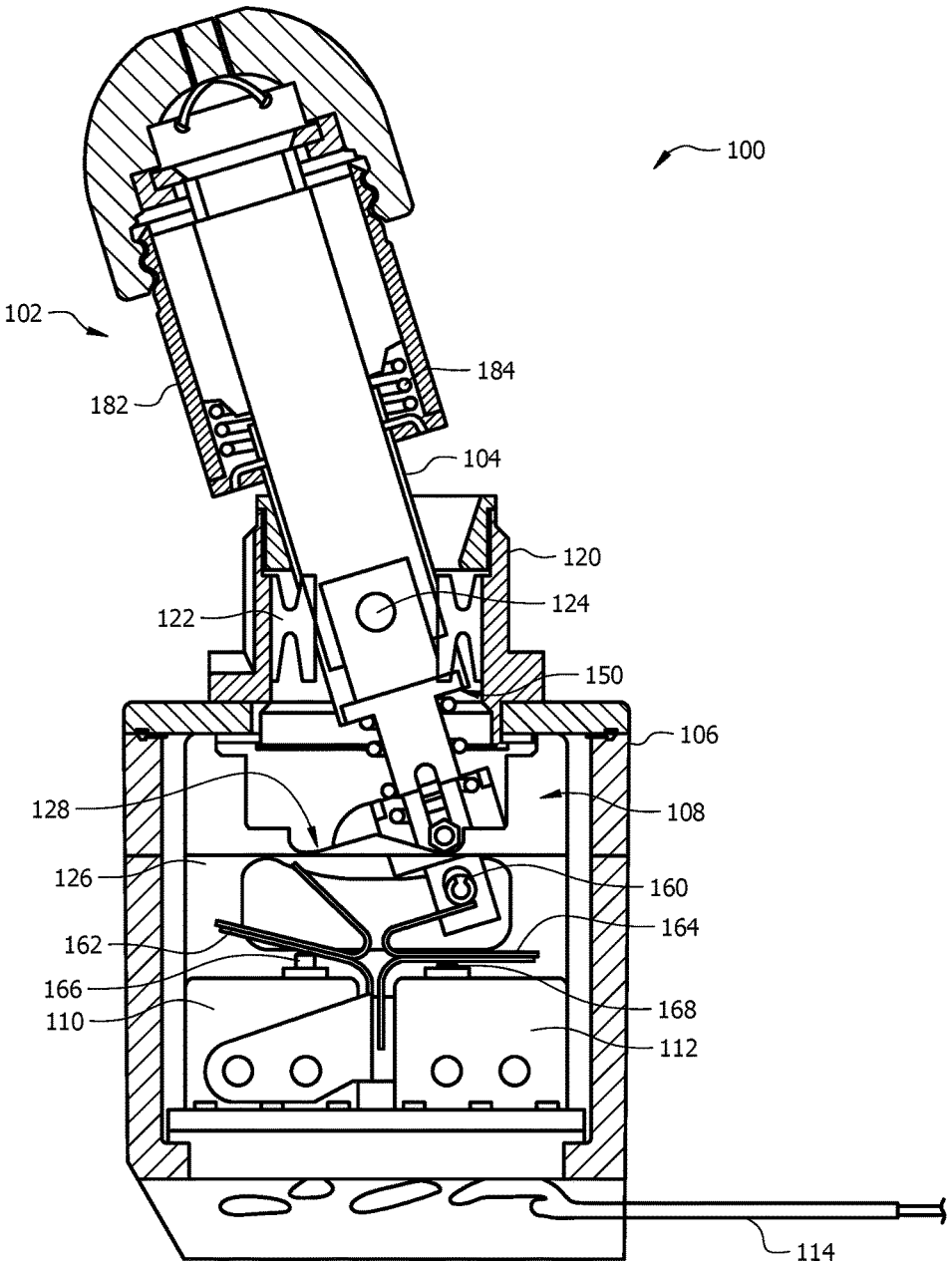
FIG. 1 is a cross-sectional view of an embodiment of a toggle switch.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Toggle switches can be manufactured with a housing that contains electrical contacts and is fitted with a manually operable handle to switch power to externally mounted terminals. In an embodiment of a toggle switch, the handle has a cam surface internal to the housing that actuates a metallic leaf spring which in turn can actuate a switch assembly to make or break electrical conductivity with the contacts.

A toggle switch can have metastability in a first position and a second position. Between these two positions, the toggle switch may be said to be in an unactuated position. Depending on the design of the toggle switch, actuation of the toggle lever at or near the center position between the actuation positions can result in the switch actuation mechanism being hung up, thereby causing the switch to be retained in the unactuated position. In this position, less than all of the switches within the toggle switch may be activated, or in some instances, no switches may be actuated. For control systems expecting one of two sets of inputs, such incomplete inputs or a lack of inputs can cause failure of the control system. When used in critical operations such as aircraft control, such failure may be catastrophic.

Disclosed herein is a toggle switch that addresses the need to avoid the actuating lever being hung up in an unactuated position. Rather, when placed at or near the central position, the toggle switch described herein will move to one of the two actuation positions without hesitation. In an embodiment, a spring can be positioned about the actuation lever. By placing the spring around the actuation lever, a relatively strong spring such as a coil spring can be used to provide a sufficient bias force on the actuation mechanism to move the actuating lever into one of the actuation positions.

In some embodiments, a cam follower can be used that includes a roller rotatably disposed about a pin. The roller may reduce any friction associated with the cam follower moving along the cam profile, which can further aid in allowing the toggle switch to assume one of the actuation positions without being retained in an unactuated position. Various other benefits and configurations are also described herein.

FIG. 1 illustrates a cross-sectional view of a toggle switch 100. The toggle switch 100 comprises a toggle mechanism 102 having an actuating lever 104 extending into a housing 106. An actuator assembly 108 can be coupled to an end of the actuating lever 104 within the housing 106 to allow actuation of a plurality of basic switches 110, 112. One or more electrical connections 114 (e.g., two or more electrical connections, etc.) can be coupled to the basic switches 110, 112 to provide signals to external devices such as controllers.

As shown in FIG. 1, the actuating lever 104 can extend from an exterior of the housing 106 into an interior of the housing 106 through a bushing or cap 120. The cap 120 can be affixed and/or sealed to the housing 106, which can include a directed coupling and/or the cap 120 can be attached to a cover that can be affixed and/or sealed to the housing 106. In some embodiments, the cap 120 can be a threaded mounting bushing, though other types of bushings and/or caps are also possible. A pivot pin 124 can be coupled to the cap 120 and extend through the actuating lever 104 to serve as a pivot point for the actuating lever 104 and control the movement of the actuating lever about the axis of the pivot pin 124. For example, the actuating lever 104 can be constrained to move in a direction normal to the longitudinal axis of the pivot pin 124 in a rotational manner.

A seal 122 can be disposed within the cap 120 and contact the actuating lever 104. The seal can comprise a flexible material such as a polymer to allow the seal to flexibly contact the exterior of the actuating lever 104 during movement of the toggle mechanism 102 between the two actuation positions. The seal may prevent dirt, moisture, or other contaminants from entering the interior of the housing 106 during use.

Figure 2:
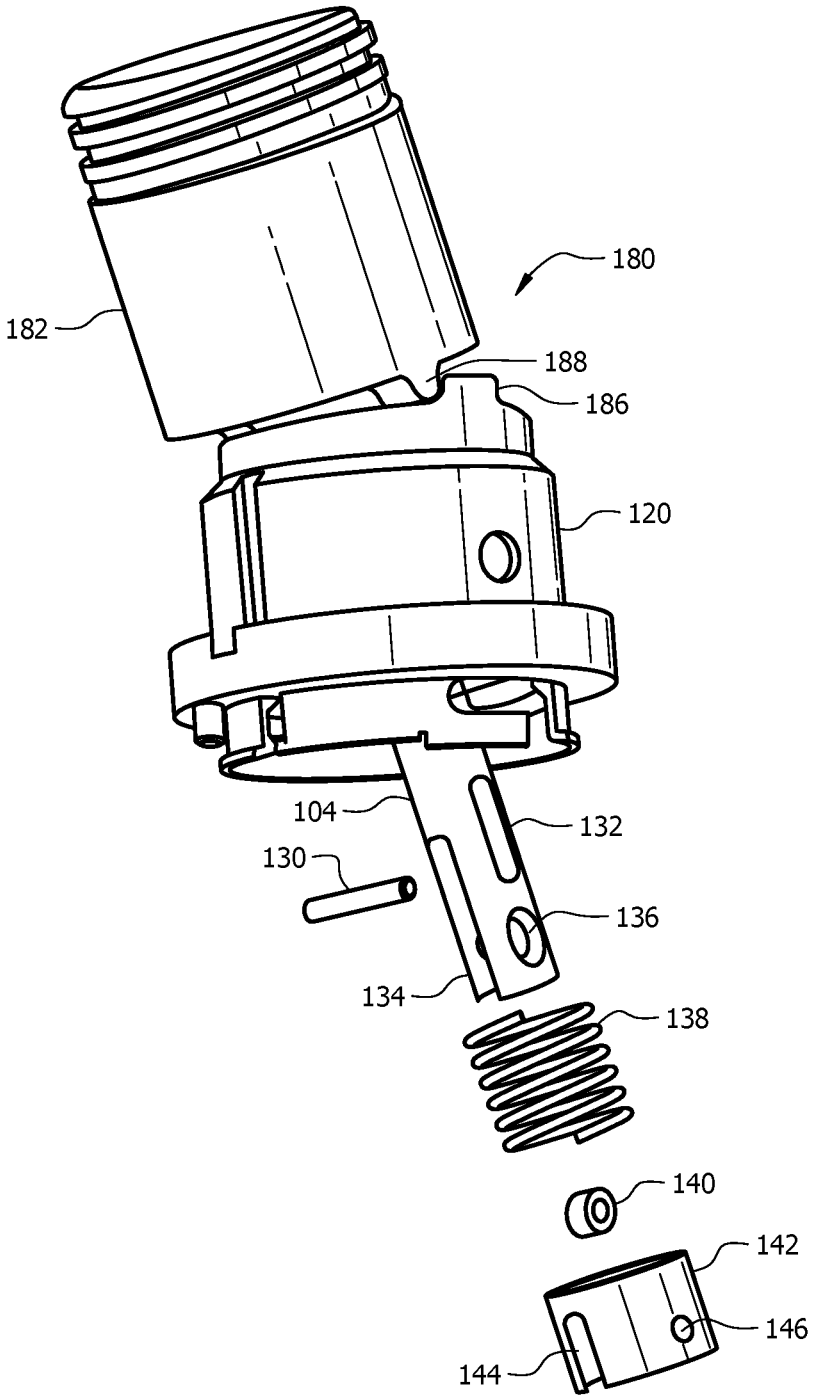
FIG. 2 is a perspective view of an embodiment of an actuating assembly for a toggle switch.

The movement of the toggle switch 100 can be controlled through the use of a roller 140 mating with a bracket 126 having a cam profile 128. As shown in FIG. 2, the actuating lever 104 can comprise a travel slot 132 configured to receive a pin 130 having the roller 140 disposed thereabout. The roller 140 disposed on the pin 130 can serve as a cam follower during use of the toggle switch 100. The travel slot 132 can comprise a longitudinal slot cut through the actuating lever 104. The travel slot 132 can be substantially aligned along the longitudinal axis of the pivot pin 124 through the actuating lever 104. The roller 140 can be rotatably disposed over the pin 130 within the interior of the actuating lever 104.

In order to maintain the toggle in one of the actuation positions, a spring 138 can be used to force the roller 140 against the cam profile 128. The actuating lever 104 can have a decreased diameter within the housing 106 as compared to a portion entering the housing 106 through the cap 120, thereby forming a shoulder 150 within the housing 106. The spring 138 can be disposed about the actuating lever 104 and abut the shoulder 150 on one end. A spring base 142 can be disposed about the actuating lever 104 and abut the spring 138 on a second end so that the spring is retained between the shoulder 150 and the spring base 142 about the actuating lever 104. The spring base 142 can comprise a hole 146 configured to receive the pin 130 extending through the actuating lever 104 in the travel slot 132.

At a fully extended position, the spring base 142 can be biased away from the cap 120 by the spring 138, where the extent of travel of the spring base 142 is limited by the travel of the pin 130 within the travel slot 132. When assembled, the roller 140 can contact the cam profile 128 on the bracket 126. The force can be transferred from the roller 140, through the pin 130 to the spring base 142, which can serve to compress the spring 138. The force provided by the compression of the spring 138 can then bias the roller away from the pivot pin 124 so that the cam profile then converts the bias into a lateral movement towards one of the two actuation positions.

The actuating lever 104 can also comprise a bracket slot 134 configured to receive the bracket 126 and retain the roller 140 in position relative to the cam profile 128. The bracket slot 134 can be aligned with the direction of movement of the actuating lever 104 to allow the actuating lever 104 to rotate about the pivot pin 124 over the bracket 126. The spring base 142 can similarly comprise a slot 144 that allows the spring base to receive the bracket 126 when the spring base 142 is disposed about the actuating lever 104.

The cam profile 128 can have a peak (e.g., a relatively sharp central peak) in a central position that corresponds to a central state between the two actuation positions. The cam profile 128 can slope away from the peak towards each actuation position and comprise a valley configured to retain the roller 140 in a stable position at each actuation position. This may help to urge the toggle switch 100 into one of two actuation positions without allowing the switch to be caught or retained in a central, unactuated position.

An end of the actuating lever 104 can comprise a hole 136 configured to receive an actuation pin 160. The hole 136 and actuation pin 160 can be aligned parallel with the pin 130 and the pivot pin 124. The actuation pin 160 can extend from the actuating lever 104 and contact one or more leaf springs 162, 164 disposed in contact with plungers 166, 168 configured to actuate the one or more basic switches. As the actuation pin 160 contacts a leaf spring, the leaf spring can be compressed and actuate the corresponding plunger to open or close an internal circuit in the basic switch, which can send a signal to an external device.

Figure 3:
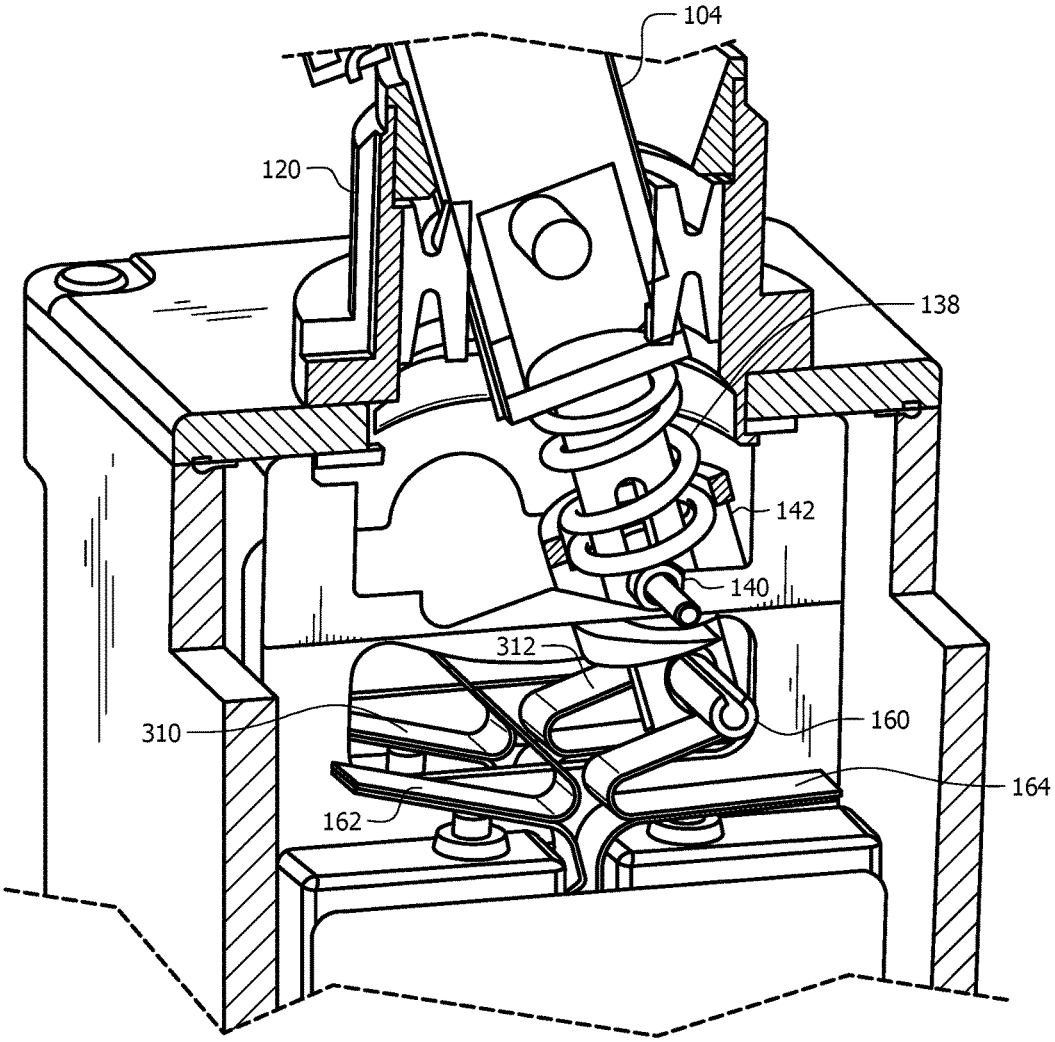
FIG. 3 is a perspective view of an embodiment of an actuating assembly within a toggle switch.

While two switches 110, 112 are shown in FIG. 1, a plurality of switches associated with a corresponding plurality of leaf springs 164, 162, 310, 312 can be included as shown in FIG. 3. In some embodiments, any plurality of switches can be used with the toggle switch 100. For example, six switches can be present in the toggle switch 100. In general, half of the switches can be actuated in a first toggle switch position with the second half being unactuated. In the second position, the first half may be unactuated, and the second half may be actuated, though the number of switches actuated in each position does not have to correspond to half of the total switches present.

Each of the switches present can be coupled to one or more electrical contacts 114 that provide signal communication between the switches 110, 112 in the housing and an external device such as control circuitry, or the like. The electrical contacts 114 can be sealed using a potting material or other sealed connection through the housing 106

In some embodiments, the switches can be configured as basic switches including miniature environmental-sealed and/or miniature hermetically sealed basic switches. Both types of enclosed basic switches can utilize standard SM/HM/SX/UX components encased within a housing formed from a corrosion resistant metal or plastic to seal the precision switch contacts from contamination. Alternatively, standard SM/HM/SX/UX components can be utilized without such a metal housing, if the design implementation does not call out the need for environmental sealing. The term "basic switch" or simply "basic" as utilized herein generally refers to a self-contained switching unit. Such a switching unit (i.e., a basic switch) can be utilized alone or in a gang-mounted configuration built into assemblies thereof or enclosed within a housing.

The force provided by the spring 138 in combination with the use of the cam profile 128 and roller 140 may prevent the toggle switch from being retained in an intermediate or unactuated position. For example, an intermediate position may result in the actuation pin 160 being positioned between the leaf springs 162, 164 so that none of the switches 110, 112 are actuated. Alternatively, the intermediate position may only result in a leaf spring (e.g., leaf spring 162, leaf spring 164, etc.) only being partially compressed, in which case the corresponding switch may or may not be activated. In this instance, some of the plurality of switches may be actuated while others may not. Such situations may result in a control scheme having errors as the expected input or combination of inputs may not be present.

In order to ensure that the toggle switch moves to one of the two actuation positions, the spring 138 may have a sufficient force when used with the roller 140 and the cam profile 128 to move to one of the two actuation positions if released in an intermediate position. The positioning of the spring 138 about the actuating lever 104 may allow a spring 138 (e.g., a coil spring, etc.) to be used with an increased bias force relative to other designs. In some embodiments, the spring 138 may provide a sufficient biasing force to overcome the friction forces associated with the seal, movement of the actuating lever 104, and the spring force from a leaf spring (e.g. leaf spring 162, 164) associated with a switch to move to a fully actuated position. In some embodiments, the spring force can be at least about 1.2 times, at least about 1.5 times, at least about 2 times the sum of the friction forces and the back force resulting from the leaf spring(s) (e.g. leaf spring 162, 164) within the toggle switch 100.

In some embodiments, an optional lock mechanism 180 can be included to retain the toggle mechanism 102 in one of the actuation positions until actuated to a second position. As shown in FIGS. 1 and 2, the lock mechanism can comprise an outer actuator 182 having a protrusion 188 disposed on an edge. The outer actuator 182 can be movably disposed about an end of the actuating lever 104, and a spring 184 can be disposed between the outer actuator 182 and the actuating lever 104. The spring 184 can be compressed to bias the outer actuator 182 towards the housing 106. A corresponding locking protrusion 186 can be present on the cap 120. The locking protrusion 186 can be present on both sides of the cap 120 in alignment with the pivot pin 124. At rest, the outer actuator 182 can be biased towards the housing 106, and the protrusion 188 on the outer actuator 182 can contact the locking protrusion 186 to prevent rotation of the actuating lever 104 about the pivot pin 124. In order to actuate the toggle switch 100, the outer actuator 182 can be pulled away from the housing 106 to overcome the spring force of spring 184, thereby raising the outer actuator 182 until the protrusion 188 on the outer actuator 182 clears the locking protrusion 186 on the cap 120. The actuating lever 104 can then be moved to the opposite actuation position. When the actuating lever 104 is disposed in the opposite actuation position and the outer actuator 182 is released, the outer actuator 182 can be biased towards the housing 106, and the protrusion 188 can contact the cap 120 and engage the opposite side of the locking protrusion 186 on the cap 120 in the actuation position. The positioning of the protrusion 188 against the cap 120 along with the contact with the locking protrusion 186 can then retain the actuating lever 104 in the actuation position.

Figure 4:
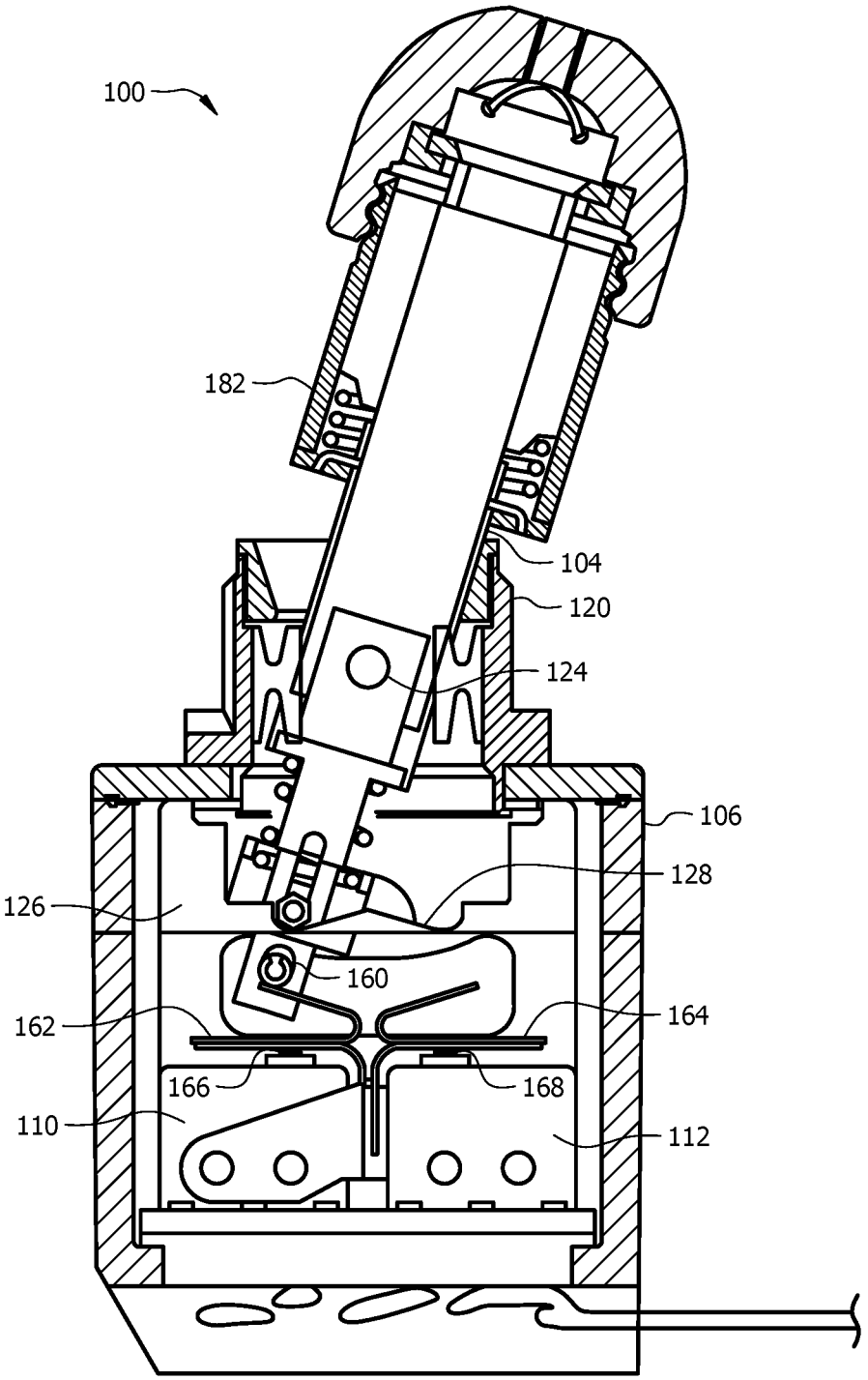
FIG. 4 is another cross-sectional view of an embodiment of a toggle switch.

In use, the toggle switch 100 actuating a first switch or plurality of switches in a first actuation position can be manipulated to deactivate the first switch or first plurality of switches and activate a second switch or plurality of switches without being retained in an intermediate position. While a plurality of switches can be present, only a single switch will be described as shown in FIGS. 1 and 4 for purposes of description, but it should be noted that the same method of operation will apply when multiple switches are present, as noted in more detail herein.

Initially, the toggle switch 100 can be in a first actuation position, as shown in FIG. 1. In order to actuate the toggle switch 100 to a second actuation position as shown in FIG. 4, the actuation mechanism 102 can first be manipulated into the opposite direction. If a lock mechanism is present, the actuation method can begin by lifting (relative to the position shown in FIG. 1) the outer actuator 182 away from the housing 106. The protrusion 188 can then clear the locking protrusion 186 on the cap 120. As the actuating lever 104 is moved (e.g., from left to right as shown in FIG. 1), the actuating lever 104 can rotate about the pivot pin 124. As the actuating lever 104 rotates, the roller 140 can be moved along the cam profile 128 due to the coupling between the pin 130 and the spring base 142. The movement of the roller 140 can cause the pin 130 to move towards the pivot pin 124 within the travel slot 132, and the spring base 142 being coupled to the pin 130 can also move towards the pivot pin 124 to compress the spring 138. The roller 140 can continue to move up and cause the spring to be compressed until the roller 140 reaches the peak in the cam profile 128.

The end of the actuating lever 104 having the actuation pin 160 disposed therethrough can move with the actuating lever 104. As the actuation pin 160 rotates with the actuating lever 104, the actuation pin 160 can move along the leaf spring 164 towards the central position. As the actuation pin 160 moves, the leaf spring 164 can be uncompressed, which can remove the force on the portion of the leaf spring 164 in contact with the plunger 168 of the switch 112. When the force on the leaf spring 164 is sufficiently removed, the plunger 168 may disconnect (or in some instances contact and/or connect) an electrical connection within the switch 112 to indicate that the switch is not being actuated. The deactivation of the switch 112 can occur prior to the actuation pin 160 being disengaged from the leaf spring 164.

If the toggle switch is released when the roller 140 is over the peak in the cam profile 128, the bias force provided by the spring 138 is sufficient to force the roller 140 to move to one side of the peak and travel to an actuation position. In other words, the bias force provided by the spring 138 is sufficient to overcome any retaining forces such as friction forces alone or in combination with the force provided by the leaf spring 164 to move from the central position to one of the actuation positions without being retained in the central position.

As the actuating lever 104 continues to travel to the position shown in FIG. 4 past the peak in the cam profile 128, the roller 140 moves along the cam profile 128. The sloped surface of the cam profile 128 serves to convert the outwards bias force provided by the spring 138 on the roller 140 into a rotational force towards the second actuation position. As the roller 140 moves along the cam profile 128 with the rotation of the actuating lever 104 about the pivot pin 124, the pin 130 moves away from the pivot pin 124 in the travel slot 132 along with the spring base 142. When the roller 140 reaches the second actuation position, the roller 140 can be retained in position based on the bias force of the spring 138 on the spring base 142.

The actuation pin 160 at the end of the actuating lever 104 moves with the actuating lever 104. As the actuation pin 160 rotates with the actuating lever 104, the actuation pin 160 can move along the leaf spring 162 towards the second actuation position and compress the leaf spring 162. The compression of the leaf spring 162 can provide a bias force on the portion of the leaf spring 162 in contact with the plunger 166 of the switch 110. When the force on the leaf spring 162 is sufficient, the plunger 166 can be actuated to make contact with (or in some instances remove contact from) an electrical connection within the switch 110 to indicate that the switch is being actuated. The activation of the switch 110 can occur prior to the actuating lever 104 reaching the fully actuated position.

In the second actuation position as shown in FIG. 4, the switch 110 can be used to provide a signal for controlling a device. As noted above, a plurality of switches can be present, and each switch can have a corresponding leaf spring configured to contact the actuation pin 160 during actuation of the toggle switch 100. This may allow the toggle switch 100 to be used with a variety of switch configurations in various uses and control schemes.

Having described various devices and methods, various embodiments can include, but are not limited to;

In a first embodiment, a toggle switch comprises a housing; a plurality of switches disposed within the housing; an actuating lever coupled to a pivot pin, wherein the actuating lever extends into the housing; and an actuator assembly coupled to the actuating lever, the actuator assembly comprising: an actuation pin coupled to the actuating lever, wherein the actuation pin is configured to actuate one or more of the plurality of switches, a spring disposed about the actuating lever, wherein the spring is configured to bias a cam follower into engagement with a cam profile on a bracket, and bias the actuating lever into an actuation position.

A second embodiment can include the toggle switch of the first embodiment, wherein the cam follower comprises a roller disposed about a pin, wherein the pin is configured to travel within a longitudinal travel slot disposed in the actuating lever.

A third embodiment can include the toggle switch of the second embodiment, wherein the pin is coupled to a spring base, wherein the spring is retained in compression about the actuating lever between the spring base and a shoulder formed on the actuating lever.

A fourth embodiment can include the toggle switch of any of the first to third embodiments, wherein the actuating lever comprises a bracket slot, and wherein the bracket slot is configured to be disposed over the bracket.

A fifth embodiment can include the toggle switch of any of the first to fourth embodiments, wherein the cam profile comprises a peak between a first actuation position and a second actuation position, wherein the spring is configured to provide a greater biasing force to the cam follower when the cam follower is at the peak than when the cam follower is at the first actuation position or the second actuation position.

A sixth embodiment can include the toggle switch of any of the first to fifth embodiments, wherein the plurality of switches comprise a plurality of basic switches.

A seventh embodiment can include the toggle switch of the sixth embodiment, further comprising a leaf spring coupled to each basic switch of the plurality of basic switches.

An eighth embodiment can include the toggle switch of the seventh embodiment, wherein the actuation pin is configured to contact one or more leaf springs associated with the plurality of basic switches to activate the corresponding switches.

A ninth embodiment can include the toggle switch of any of the first to eighth embodiments, further comprising a cap coupled to the housing, wherein the actuating lever extends through the cap into the housing, and wherein the pivot pin is coupled to the cap.

A tenth embodiment can include the toggle switch of the ninth embodiment, further comprising a flexible seal retained within the cap, wherein the flexible seal is configured to engage the actuating lever within the cap.

An eleventh embodiment can include the toggle switch of the ninth or tenth embodiment, further comprising a locking mechanism, wherein the locking mechanism comprises: an outer actuator movably disposed about the actuating lever; a protrusion disposed on the outer actuator; and a locking protrusion disposed on the cap, wherein the protrusion on the outer actuator is configured to engage the locking protrusion on the cap when the outer actuator is in a first position, and wherein the protrusion on the outer actuator is configured to move past the locking protrusion on the cap when the outer actuator is in a second position.

In a twelfth embodiment, a method of operating a toggle switch, the method comprises providing an actuation force to an actuating lever while the actuating lever is in a first actuation position; moving a cam follower along a cam profile from the first actuation position to a peak in the cam profile in response to the actuation force; compressing a spring disposed about the actuating lever in response to the moving; de-actuating a first switch in response to the moving; actuating the cam follower along the cam profile from the peak to a second actuation position based, at least in part, on a bias force provided by the compressed spring; and actuating a second switch in response to actuating the cam follower to the second actuation position.

A thirteenth embodiment can include the method of the twelfth embodiment, wherein moving the cam follower along the cam profile comprises rotating a roller disposed on a pin along the cam profile.

A fourteenth embodiment can include the method of the twelfth or thirteenth embodiment, wherein the bias force provided by the compressed spring overcomes any retention forces biasing the cam follower to remain at a position other than the first actuation position or the second actuation position.

A fifteenth embodiment can include the method of any of the twelfth to fourteenth embodiments, further comprising: unlocking the actuating lever prior to providing the actuation force.

A sixteenth embodiment can include the method of any of the twelfth to fifteenth embodiments, further comprising: rotating the actuating lever about a pivot pin in response to the actuation force, wherein the cam follower moves in response to the rotation of the actuating lever about the pivot pin.

A seventeenth embodiment can include the method of any of the twelfth to sixteenth embodiments, wherein actuating the second switch comprises: contacting an actuation pin coupled to the actuating lever with a leaf spring coupled to the second switch; compressing the leaf spring in response to the contact; and actuating the second switch in response to compressing the leaf spring.

In an eighteenth embodiment, a toggle switch comprises a housing; a plurality of switches disposed within the housing; an actuating lever configured to rotate about a pivot point, wherein the actuating lever extends into the housing; and an actuator assembly coupled to the actuating lever, the actuator assembly comprising: an actuation pin coupled to the actuating lever, wherein the actuation pin is configured to actuate one or more of the plurality of switches, a spring configured to bias a cam follower into engagement with a cam profile and bias the actuating lever into an actuation position, wherein the cam follower comprises a roller rotatably coupled to a pin, wherein the pin is coupled to the actuating lever.

A nineteenth embodiment can include the toggle switch of the eighteenth embodiment, wherein the pin is configured to travel within a longitudinal travel slot disposed in the actuating lever.

A twentieth embodiment can include the toggle switch of the nineteenth embodiment, wherein the pin is coupled to a spring base, wherein the spring is retained in compression about the actuating lever between the spring base and a shoulder formed on the actuating lever.

A twenty first embodiment can include the toggle switch of any of the eighteenth to twentieth embodiments, wherein the cam profile comprises a peak between a first actuation position and a second actuation position, wherein the spring is configured to provide a greater biasing force to the cam follower when the cam follower is at the peak than when the cam follower is at the first actuation position or the second actuation position.

A twenty second embodiment can include the toggle switch of any of the eighteenth to twenty first embodiments, wherein the plurality of switches comprise a plurality of basic switches.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A toggle switch comprising:

a housing;

a plurality of switches disposed within the housing;

an actuating lever coupled to a pivot pin, wherein the actuating lever extends into the housing; and an actuator assembly coupled to the actuating lever, the actuator assembly comprising:

an actuation pin coupled to the actuating lever, wherein the actuation pin is configured to actuate one or more of the plurality of switches, and a spring disposed about an outer surface of the actuating lever, wherein the spring is configured to bias a cam follower into engagement with a cam profile on a bracket, and bias the actuating lever into an actuation position, wherein the cam follower comprises a roller disposed about a pin, wherein the pin is configured to travel within a longitudinal travel slot disposed in the actuating lever.

2. The toggle switch of claim 1, wherein the pin is coupled to a spring base, wherein the spring is retained in compression about the actuating lever between the spring base and a shoulder formed on the actuating lever.

3. The toggle switch of claim 1, wherein the actuating lever comprises a bracket slot, and wherein the bracket slot is configured to be disposed over the bracket.

4. The toggle switch of claim 1, wherein the cam profile comprises a peak between a first actuation position and a second actuation position, wherein the spring is configured to provide a greater biasing force to the cam follower when the cam follower is at the peak than when the cam follower is at the first actuation position or the second actuation position.

5. The toggle switch of claim 1, wherein the plurality of switches comprise a plurality of basic switches.

6. The toggle switch of claim 5, further comprising a leaf spring coupled to each basic switch of the plurality of basic switches.

7. The toggle switch of claim 6, wherein the actuation pin is configured to contact one or more leaf springs associated with the plurality of basic switches to activate the corresponding switches.

8. The toggle switch of claim 1, further comprising a cap coupled to the housing, wherein the actuating lever extends through the cap into the housing, and wherein the pivot pin is coupled to the cap.

9. The toggle switch of claim 8, further comprising a flexible seal retained within the cap, wherein the flexible seal is configured to engage the actuating lever within the cap.

10. The toggle switch of claim 8, further comprising a locking mechanism, wherein the locking mechanism comprises:

an outer actuator movably disposed about the actuating lever;

a protrusion disposed on the outer actuator; and a locking protrusion disposed on the cap, wherein the protrusion on the outer actuator is configured to engage the locking protrusion on the cap when the outer actuator is in a first position, and wherein the protrusion on the outer actuator is configured to move past the locking protrusion on the cap when the outer actuator is in a second position.

11. A method of operating a toggle switch, the method comprising:

providing an actuation force to an actuating lever while the actuating lever is in a first actuation position;

moving a cam follower along a cam profile from the first actuation position to a peak in the cam profile in response to the actuation force, wherein moving the cam follower along the cam profile comprises rotating a roller disposed on a pin along the cam profile, and moving the pin in a longitudinal direction within a longitudinal travel slot disposed in the actuating lever;

compressing a spring disposed about an outer surface of the actuating lever in response to the moving;

de-actuating a first switch in response to the moving;

actuating the cam follower along the cam profile from the peak to a second actuation position based, at least in part, on a bias force provided by the compressed spring; and actuating a second switch in response to actuating the cam follower to the second actuation position.

12. The method of claim 11, wherein the bias force provided by the compressed spring overcomes any retention forces biasing the cam follower to remain at a position other than the first actuation position or the second actuation position.

13. The method of claim 11, further comprising:

unlocking the actuating lever prior to providing the actuation force.

14. The method of claim 11, further comprising:

rotating the actuating lever about a pivot pin in response to the actuation force, wherein the cam follower moves in response to the rotation of the actuating lever about the pivot pin.

15. The method of claim 11, wherein actuating the second switch comprises:

contacting an actuation pin coupled to the actuating lever with a leaf spring coupled to the second switch;

compressing the leaf spring in response to the contacting; and actuating the second switch in response to compressing the leaf spring.

16. A toggle switch comprising:

a housing;

a plurality of switches disposed within the housing;

an actuating lever configured to rotate about a pivot point, wherein the actuating lever extends into the housing; and an actuator assembly coupled to the actuating lever, the actuator assembly comprising:

an actuation pin coupled to the actuating lever, wherein the actuation pin is configured to actuate one or more of the plurality of switches, and a spring disposed about an outer surface of the actuating lever and configured to bias a cam follower into engagement with a cam profile and bias the actuating lever into an actuation position, wherein the cam follower comprises a roller rotatably coupled to a pin, wherein the pin is coupled to the actuating lever, and wherein the pin is configured to travel within a longitudinal travel slot disposed in the actuating lever.

17. The toggle switch of claim 16, wherein the pin is coupled to a spring base, wherein the spring is retained in compression about the actuating lever between the spring base and a shoulder formed on the actuating lever.

* * * * *